US008695808B2

(12) United States Patent
Cartal et al.

(10) Patent No.: US 8,695,808 B2
(45) Date of Patent: Apr. 15, 2014

(54) METHOD OF SORTING MAILPIECES BY MEANS OF SHUTTLE TRAYS OF VARIABLE STORAGE CAPACITY

(75) Inventors: Bruno Cartal, Montelier (FR); Eric Moullard, Saint Paul les Romans (FR); Damien Hugues, Bourg les Valence (FR)

(73) Assignee: Solystic, Gentilly Cedex (FR)

( * ) Notice: Subject to any disclaimer, the term of this patent is extended or adjusted under 35 U.S.C. 154(b) by 310 days.

(21) Appl. No.: 13/142,352

(22) PCT Filed: Mar. 15, 2011

(86) PCT No.: PCT/FR2011/050516

§ 371 (c)(1),
(2), (4) Date: Jun. 27, 2011

(87) PCT Pub. No.: WO2011/114053

PCT Pub. Date: Sep. 22, 2011

(65) Prior Publication Data

US 2012/0027563 A1 Feb. 2, 2012

(30) Foreign Application Priority Data

Mar. 18, 2010 (FR) ..... 10 51951

(51) Int. Cl.
*B07C 3/04* (2006.01)

(52) U.S. Cl.
USPC ..... 209/706; 209/1; 209/584; 209/900

(58) Field of Classification Search
USPC ..... 209/12.1, 584, 702, 706, 900
See application file for complete search history.

(56) References Cited

U.S. PATENT DOCUMENTS

| | | | | |
|---|---|---|---|---|
| 4,643,306 | A * | 2/1987 | Ryan | 206/425 |
| 2002/0031284 | A1 | 3/2002 | Pippin et al. | |
| 2009/0028678 | A1 * | 1/2009 | Kutzer | 414/351 |
| 2012/0027563 | A1 * | 2/2012 | Cartal et al. | 414/806 |

FOREIGN PATENT DOCUMENTS

| | | | |
|---|---|---|---|
| FR | 2552743 | A1 | 4/1985 |
| FR | 2667807 | A1 | 4/1992 |
| WO | WO 9736805 | A1 | 10/1997 |

* cited by examiner

*Primary Examiner* — Terrell Matthews
(74) *Attorney, Agent, or Firm* — Rothwell, Figg, Ernst & Manbeck, P.C.

(57) ABSTRACT

In a method of sorting mailpieces, in which method the mailpieces sorted into the sorting outlets of a postal sorting machine are transferred from said sorting outlets to an unstacker magazine of the machine, or to an unstacker magazine of another sorting machine for the purpose of being sorted again into sorting outlets, said mailpieces are handled by means of shuttle trays of variable storage capacity for the purpose of transferring them from the sorting outlets to the unstacker magazine.

6 Claims, 1 Drawing Sheet

METHOD OF SORTING MAILPIECES BY MEANS OF SHUTTLE TRAYS OF VARIABLE STORAGE CAPACITY

CROSS-REFERENCE TO RELATED APPLICATION

This application is a 35 U.S.C. §371 National Phase Application from PCT/FR2011/050516, filed Mar. 15, 2011, designating the United States and also claims the benefit of French Application No. 1051951, filed Mar. 18, 2010, the disclosure of which are incorporated herein by reference in their entirety.

TECHNICAL FIELD

The invention relates to a method of sorting mailpieces, in which method mailpieces are placed in a stack on edge in an unstacker magazine of a postal sorting machine, and then the unstacked mailpieces are conveyed on edge by a sorting conveyor so as to be directed towards sorting outlets of the machine, where they are stored in stacks on edge in storage receptacles associated with respective ones of said sorting outlets, and then the mailpieces sorted into the sorting outlets are transferred from said sorting outlets to an unstacker magazine of the machine, or to an unstacker magazine of another sorting machine for the purpose of being sorted again into sorting outlets.

PRIOR ART

A sorting process in one or more machines generally comprises a plurality of sorting passes, e.g. for preparing delivery rounds or "postman's walks". At the end of a sorting pass, the mailpieces sorted into the sorting outlets must be recirculated for further machine sorting and thus be brought towards the unstacker magazine of a sorting machine in order for a subsequent sorting pass to be performed.

Patent document US 2002/031284 describes a postal sorting structure in the form of a mail case having slots. In that structure, hanging inserts are mounted in the case slots for storing the sorted mail on edge. In order to enable the mail to be handled, trays including removable dividers are used. However, that mail case structure does not perform the same functions as a postal sorting machine with a sorting conveyor, and the steps for implementing such sorting are not specified.

Patent Document U.S. Pat. No. 4,643,306 discloses a mail storage tray that has separators that are made of metal and therefore that cannot be used in a sorting conveyor.

In addition, Patent Document WO 97/36805 describes a postal sorting machine with an unstacker magazine, a sorter, and sorting outlets with trays. A robot is provided for handling empty trays or full trays between the sorting outlets. In an example that is shown, the tray has a non-removable opening front wall hinged to the body of the tray.

Finally, examples of storage receptacles for sorting outlets are, for example, described in Patent Documents US 2009/0 028 678, FR 2 552 743, and FR 2 667 807. Each storage receptacle of the drawer type is generally provided permanently in a recess of a sorting outlet of the machine, and the mailpieces stored in the storage receptacle must be transferred to a handling tray or bin in order for them to be brought back towards an unstacker magazine. At the unstacker magazine, the mailpieces must further be taken in handfuls from the trays and placed in a stack on edge on the belt of the unstacker magazine. All of these mailpiece handling operations for recirculating the mailpieces from sorting outlets towards an unstacker magazine of a sorting machine require a large amount of time and of attention on the part of the machine operators. In addition, those handling operations are arduous. During the course of a day's work, a machine operator can thus handle several tons of mail, raising problems of ergonomics for those work stations. In addition, the stacks of mailpieces in the handling trays can collapse if they are not sufficiently tightly packed, and that can give rise to the mailpieces no longer being in the chronological order of processing, and thus give rise to additional operations for restructuring the mailpieces in the unstacker magazine.

SUMMARY OF THE INVENTION

An object of the invention is to mitigate those drawbacks and to propose an alternative method of sorting mailpieces.

To this end, the invention provides a method of sorting mailpieces, in which method mailpieces are placed in a stack on edge in an unstacker magazine of a postal sorting machine, and then the unstacked mailpieces are conveyed on edge by a sorting conveyor so as to be directed towards sorting outlets of the postal sorting machine, where they are stored in stacks on edge in storage receptacles associated with respective ones of said sorting outlets, and then the mailpieces sorted into the sorting outlets are transferred from said sorting outlets to an unstacker magazine of the postal sorting machine, or to an unstacker magazine of another postal sorting machine for the purpose of being sorted again into sorting outlets, said method being characterized in that, in order to transfer the mailpieces between the sorting outlets and the unstacker magazine, said mailpieces are handled by means of shuttle trays of variable storage capacity in the following steps: a) storing the mailpieces from a sorting outlet in a shuttle tray having a bottom wall on which the mailpieces rest in a stack on edge, and a back wall that is substantially perpendicular to the bottom wall and against which the stack of mailpieces on edge bears; b) positioning a front wall on the bottom wall of the shuttle tray in a manner such that it is parallel to the back wall and while moving it closer to the back wall so that the stack of mailpieces is clamped between the back wall and the front wall of the shuttle tray, said front wall being a plate that is removable relative to the bottom wall and being positionable on the bottom wall of the shuttle tray in a plurality of positions so as to be moved closer to or further away from the back wall while remaining parallel thereto; and c) placing the shuttle tray filled with mailpieces in horizontal alignment with the unstacker magazine of the sorting machine, and removing the removable front wall of the tray so as to slide the mailpieces on the surface of the unstacker magazine.

In features of the method of the invention:

- the front wall of a shuttle tray is a flexible plate, the method including the step of conveying the front wall of a shuttle tray in the sorting conveyor of the postal sorting machine between the unstacker magazine and a sorting outlet;
- the shuttle trays of variable storage capacity are used as storage receptacles associated with the sorting outlets;
- each removable front wall of a shuttle tray is positioned on the bottom wall of the shuttle tray at a sorting outlet or is removed from the shuttle tray at the unstacker magazine by means of an automatic positioning or removal system;
- the method includes the step of grouping together a plurality of shuttle trays on a movable rack forming a carrousel in which the shuttle trays can be moved through space along a looped path extending in the height direction; and
- the looped path is rectangular in shape.

The basic idea of the invention is thus to use shuttle trays of variable storage capacity with removable partitions as substitutes for conventional handling trays with non-removable partitions. The shuttle trays of variable capacity of the invention may also be arranged to be used as sorting outlet receptacles, e.g. of the drawer type, and thus be positioned in the recesses of the sorting outlets, in particular sorting outlets of the accumulator or stacker type. In particular, each of them must then be arranged to receive a conventional movable paddle for retaining a stack of mailpieces for sorting outlets of the accumulator type.

In accordance with the invention, flexible partitions for shuttle trays are, for example, placed on edge in a stack in the unstacker magazine at the end of a first mailpiece sorting pass. They are unstacked automatically and conveyed towards the sorting outlets of the machine like conventional mailpieces. The machine operator then merely has to position each partition in a shuttle tray in such a manner as to clamp the stack of mailpieces stored in the shuttle tray. The shuttle trays are then removed from the sorting outlets and brought towards the unstacker magazine. The machine can then be equipped with a shuttle tray recirculation system suitable for automatically conveying the trays from the sorting outlets to the unstacker magazine. Alternatively, it is possible to use a trolley or the like for conveying several shuttle trays at a time towards the unstacker magazine. At the unstacker magazine, and tray-after-tray, the machine operator removes the removable flexible partition from the tray so as to empty the contents thereof into the unstacker magazine. The partitions may then be placed in a stack again in the unstacker magazine so as to be unstacked automatically and so as to be directed towards the sorting outlets.

BRIEF DESCRIPTION OF THE DRAWING

The characteristics and advantages of the invention can be even better understood on reading the following description of an implementation shown in the drawing, in which.

DESCRIPTION OF IMPLEMENTATIONS

Overall, a shuttle tray of variable storage capacity of the invention is a tray having a bottom wall on which the mailpieces rest on edge, a back wall secured to the bottom wall while being substantially perpendicular thereto and against which the front of a stack of mailpieces can bear, and a front wall that is substantially parallel to the back wall and against which the back of a stack of mailpieces can bear. The shuttle tray may also have one or two sides secured to the bottom wall and to the back wall. The front wall is a removable partition that that can be positioned at various points relative to the back wall so as to be positioned closer thereto or further away therefrom in order to clamp a stack of mailpieces between said back wall and said front wall.

Figure 1:
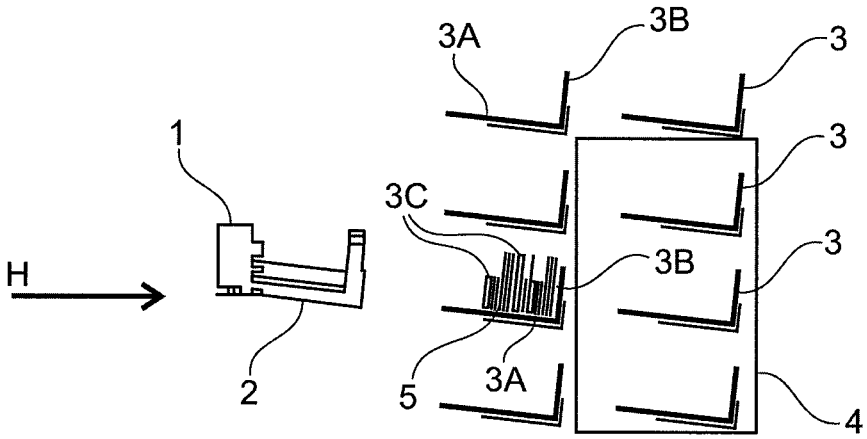
FIG. 1 is a highly diagrammatic view of a situation of emptying sorting outlets using shuttle trays of the invention.

FIG. 1 shows a sorting outlet 1 of a postal sorting machine (not shown) with a conventional storage receptacle 2 of the drawer type. It is understood that a postal sorting machine has several tens of sorting outlets. Shuttle trays are shown in side views under reference 3 in a handling configuration on a movable rack 4. Each of them is shown with a bottom wall 3A and with a back wall 3B. Eight shuttle trays 3 are grouped together on the movable rack 4 forming a sort of looped support (represented by a rectangle in the drawing) that extends vertically and that is arranged like a carrousel so that the shuttle trays 3 can be moved through space along the rectangular loop so as to be positioned at the desired heights.

In the configuration shown in FIG. 1, the mailpieces stored in a stack on edge in the receptacle 2 are taken in handfuls and are transferred to a shuttle tray 3. In order to perform this operation, an empty shuttle tray 3 can be brought to the horizontal level (indicated by arrow H) of the receptacle 2 to be emptied. As shown in FIG. 1, the front of the stack of mailpieces 5 in the shuttle tray 3 bears against the back wall 3B whereas the back of said stack is held, in this example, by one or more removable partitions designated by 3C.

Figure 2:
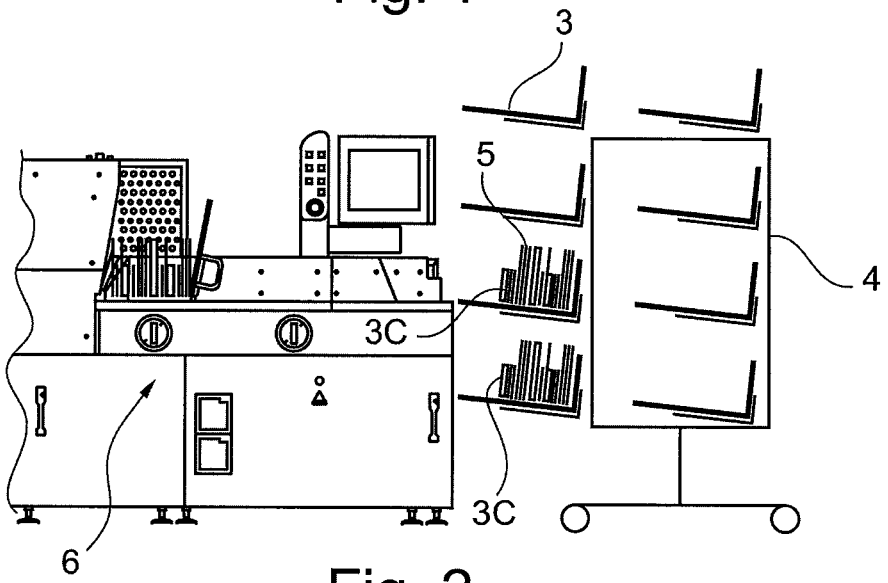
FIG. 2 is a highly diagrammatic view of a situation of emptying shuttle trays of the invention into an unstacker magazine of a sorting machine.

In FIG. 2, the shuttle trays 3 of FIG. 1 are shown in front of an unstacker magazine 6 of a sorting machine. In this example, the rack 4 is shown on a wheeled base. In order to unload the shuttle tray 3 filled with mailpieces 5, the operator firstly places the shuttle tray 3 substantially in horizontal alignment with the surface of the unstacker magazine 6. Then, in this example, the operator removes a first removable partition 3C, takes hold of a handful mailpieces and slides them on the surface of the unstacker magazine 6. It is possible to have a plurality of removable partitions 3C in the same shuttle tray 3 so as to hold the mailpieces more firmly in a stack 5 on edge.

Figure 3:
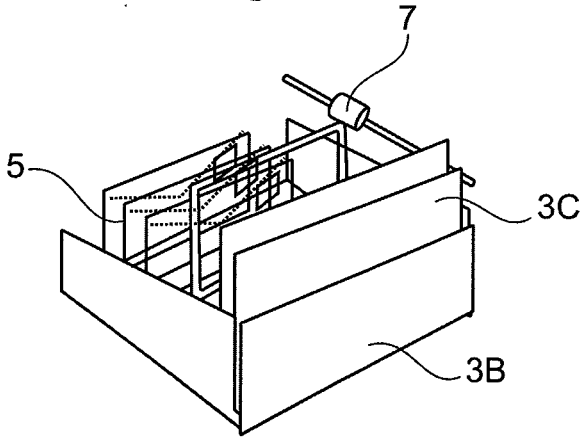
FIG. 3 is a highly diagrammatic view of a shuttle tray of variable storage capacity of the invention.

FIG. 3 is a perspective view of a shuttle tray 3 of variable storage capacity. In this example, the shuttle tray is in the shape of a rectangular trough made up of four connected-together walls and of one removable wall or partition 3C. FIG. 3 shows two removable partitions 3C placed against the back wall 3B. Each removable partition 3C is in the form of a plate that can be fastened to the bottom wall of the tray by a fastening system of the type comprising studs and a series of holes, for example. Inside the shuttle tray, FIG. 3 also shows a paddle 7 for holding a stack of mailpieces 5, which paddle is mounted to move in the shuttle tray 3. This configuration corresponds to a shuttle tray 3 that is specially arranged to be usable as a substitute for a stacker or accumulator sorting outlet receptacle, and that can also offer the possibility of being extractable from the recess of the sorting outlet so as to be handled as shown in FIGS. 1 and 2.

It is possible to provide lids for the shuttle trays 3 so that they can be stacked up once they are filled, in particular for the purposes of transporting them. The shuttle trays 3 may advantageously be designed to nest together when they are empty. They may be provided with electronic identification labels of the Radio Frequency Identification (RFID) tag type.

The removable partitions 3C of the shuttle trays 3 may be designed as flexible plates that can pass through a sorting conveyor of a sorting machine. The sorting machine may advantageously be equipped with an automatic removal and positioning system for automatically removing the flexible partitions from the shuttle trays 3 and for automatically positioning said flexible partitions therein both at the sorting outlets and at the unstacker magazine.

Advantageously, said shuttle trays 3 of variable storage capacity of the invention make it possible to optimize handling of the mailpieces. Stacks of mailpieces can be easily concatenated in said shuttle trays 3 by means of removable partitions, thereby making it possible, within the same volume, to transport shuttle trays 3 that are better filled. This therefore makes it possible to reduce the transport costs, and thus to optimize the operating costs of a postal sorting machine.

The invention claimed is:

1. A method of sorting mailpieces, said method comprising the steps of placing the mailpieces in a stack on edge in an unstacker magazine of a postal sorting machine, conveying the unstacked mailpieces on edge by a sorting conveyor so as to be directed towards sorting outlets of the postal sorting machine, storing the mailpieces in stacks on edge in storage receptacles associated with respective ones of said sorting outlets, transferring the mailpieces sorted into the sorting outlets from said sorting outlets to an unstacker magazine of the postal sorting machine, or to an unstacker magazine of another postal sorting machine for the purpose of being sorted again into sorting outlets, wherein in order to transfer the mailpieces between the sorting outlets and the unstacker magazine, said mailpieces are handled by means of shuttle trays of variable storage capacity in the following steps:

a) storing the mailpieces from a sorting outlet in a shuttle tray having a bottom wall on which the mailpieces rest in a stack on edge, and a back wall that is substantially perpendicular to the bottom wall and against which the stack of mailpieces on edge bears;

b) positioning a front wall on the bottom wall of the shuttle tray in a manner such that it is parallel to the back wall and while moving it closer to the back wall so that the stack of mailpieces is clamped between the back wall and the front wall of the shuttle tray, said front wall being a plate that is removable relative to the bottom wall and being positionable on the bottom wall of the shuttle tray in a plurality of positions so as to be moved closer to or further away from the back wall while remaining parallel thereto; and c) placing the shuttle tray filled with mailpieces in horizontal alignment with the unstacker magazine of the sorting machine, and removing the removable front wall of the shuttle tray so as to slide the mailpieces on the surface of the unstacker magazine.

2. A method according to claim 1, wherein the front wall of a shuttle tray is a flexible plate, and wherein the method includes the step of conveying the front wall of a shuttle tray in the sorting conveyor of the postal sorting machine between the unstacker magazine and a sorting outlet.

3. A method according to claim 1, wherein the shuttle trays of variable storage capacity are used as storage receptacles associated with the sorting outlets.

4. A method according to claim 3, wherein each removable front wall of a shuttle tray is positioned on the bottom wall of the shuttle tray at a sorting outlet or is removed from the shuttle tray at the unstacker magazine by means of an automatic positioning or removal system.

5. A method according to claim 1, further comprising the step of grouping together a plurality of shuttle trays on a movable rack forming a carrousel in which the shuttle trays can be moved through space along a looped path extending in the height direction.

6. A method according to claim 5, wherein the looped path is rectangular in shape.

* * * * *